US005323798A

United States Patent [19]

Yang

[11] Patent Number: 5,323,798

[45] Date of Patent: Jun. 28, 1994

[54] FLASHING UMBRELLA

[76] Inventor: Chiu-Hsiung Yang, No. 6, Lane 18, Kung Shang Rd., Wu Ku Hsiang, Taipei Hsien, Taiwan

[21] Appl. No.: 57,259

[22] Filed: May 4, 1993

[51] Int. Cl.[5] ..... A45B 3/00

[52] U.S. Cl. ..... 135/16; 135/910; 362/102

[58] Field of Search ..... 135/910, 911, 16, 31, 135/66; 362/102, 157

[56] References Cited

U.S. PATENT DOCUMENTS

| | | | |
|---|---|---|---|
| 1,166,272 | 12/1915 | Smithing | 135/910 X |
| 1,595,023 | 8/1926 | Probe | 362/102 |
| 1,795,268 | 3/1931 | Thomases | 135/910 X |
| 2,878,366 | 3/1959 | Evans, Jr. | 135/910 X |
| 4,020,858 | 5/1977 | Wilson | 135/910 X |
| 4,031,381 | 6/1977 | Carver | 135/910 X |
| 4,093,969 | 6/1978 | Maynor, Jr. | 135/910 X |
| 4,848,385 | 7/1989 | Pennella | 135/910 X |
| 4,962,779 | 10/1990 | Meng | 135/910 X |
| 5,003,437 | 3/1991 | Barrett | 362/102 X |
| 5,063,953 | 11/1991 | Wu | 135/31 X |
| 5,135,016 | 8/1992 | Stiller | 135/31 X |

FOREIGN PATENT DOCUMENTS

| | | | |
|---|---|---|---|
| 2222942 | 3/1990 | United Kingdom | 135/910 |

*Primary Examiner*—Carl D. Friedman
*Assistant Examiner*—Lan C. Mai
*Attorney, Agent, or Firm*—Merchant, Gould, Smith, Edell, Welter & Schmidt

[57] ABSTRACT

A flashing umbrella allowed to emit flashing light on rainy, dark day has a tubular handle connected to a hollow rod which is further connected to an upper tube. An upper collar is engaged at the upper periphery of the rod having a plurality of ribs pivotally extending therefrom. A plurality of LEDs each is installed at the end of a corresponding rib. The tubular handle has a circuit board and a battery installed therein for providing electrical pulses from the circuit board. A button switch is installed on the tubular handle for controlling the ON/-OFF of the circuit board. A positive electrical line and a negative electrical line extend from the circuit board and elongate upward inside the rod and each having a plurality of branches each extending therefrom to electrically connect a corresponding LED, thereby transmitting the electrical pulses from the circuit board to the LEDs and enable the latter to flash.

2 Claims, 3 Drawing Sheets

FLASHING UMBRELLA

BACKGROUND OF THE INVENTION

This invention relates to a flashing umbrella especially one which is allowed to be manually operated to generate light in dark.

Umbrellas used at the present time do not contain a flashing effect thus on a rainy, dark day the user is in danger of being hit by a car.

SUMMARY OF THE INVENTION

It is an object of the present invention to provide a flashing umbrella which allows the user to press a button thereon and generate flashing light thus indicating the presence of the user on a rainy, dark day.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
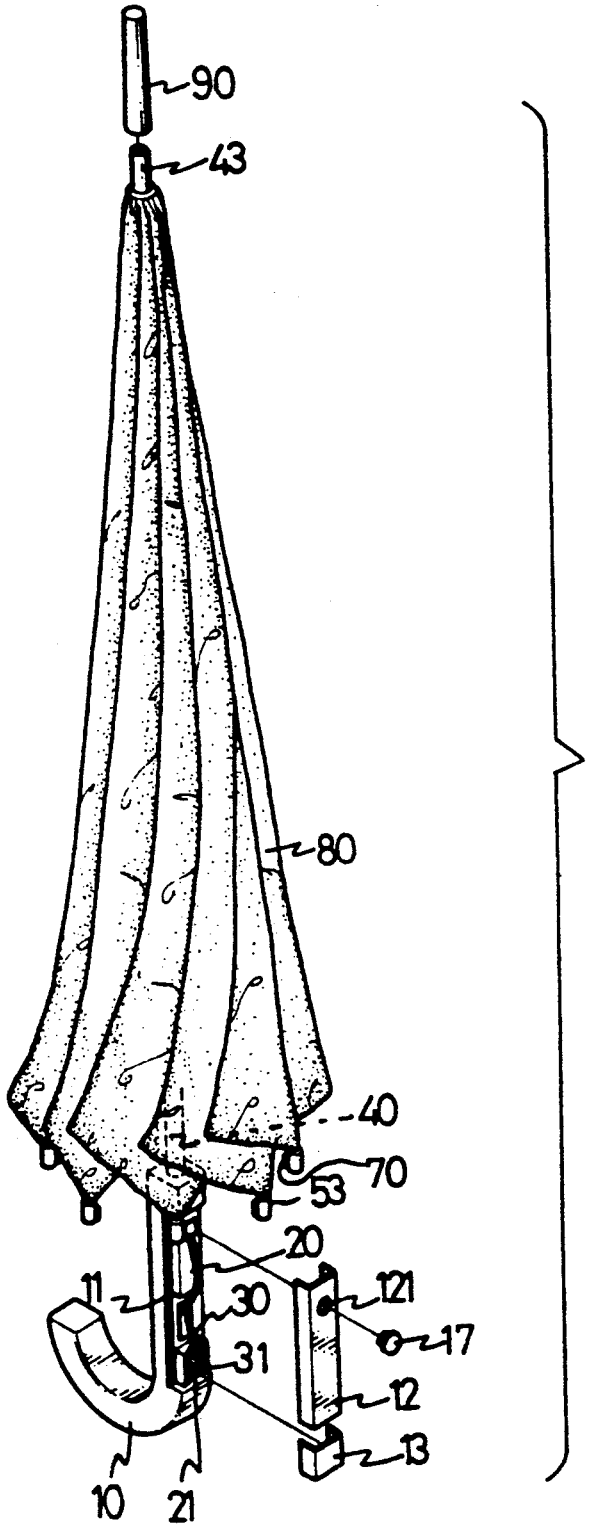
FIG. 1 is a perspective view partially illustrating a sectional view of an umbrella in accordance with the present invention.

Now referring to the drawings and initially to FIG. 1, a flashing umbrella shown in a preferred embodiment in accordance with the present invention generally comprises a handle 10, a rod 40 connected thereto, an upper tube 43 connected to the rod 40, a gore structure 80 similar to that of the well known umbrella, a plurality of tips 53 formed at the periphery side of the gore structure 80, and a plurality of light emitting diodes 70 each being attached on a corresponding tip 53. The handle 10 basically is a tube structure having a recess 11 on one face thereof for receiving a battery 21 and a circuit board 20. The rod 40 is basically a hollow structure and is in communication with the upper tube 43 and the handle 10. The circuit board 20 can generate electrical pulses for actuating the light emitting diodes 70 to flash. Since the flashing circuit is well known, it is not described in detail herein. A positive electrical line 30 and a negative electrical line 31 extend from the circuit board 20 for providing electrical pulses thereacross. A first cover 12 is allowed to fit on an upper portion of the recess 11 suitable to cover the circuit board 20. A second cover 13 is allowed to fit on a lower portion of the recess 11 suitable to cover the battery 21. The user merely takes off the second cover 13 from the handle 10 when he wants to change the battery 21. A first hole 121 is formed on the first cover 12 for receiving a button switch 17 which is allowed to be depressed to contact the circuit board 20 thus turning ON/OFF the circuit board 20, which in turn enables/disables the LEDs 70 to flash. The theory of the button switch 17 is similar to that used in the power button of a remote control of a television set and not described herein.

Figure 2:
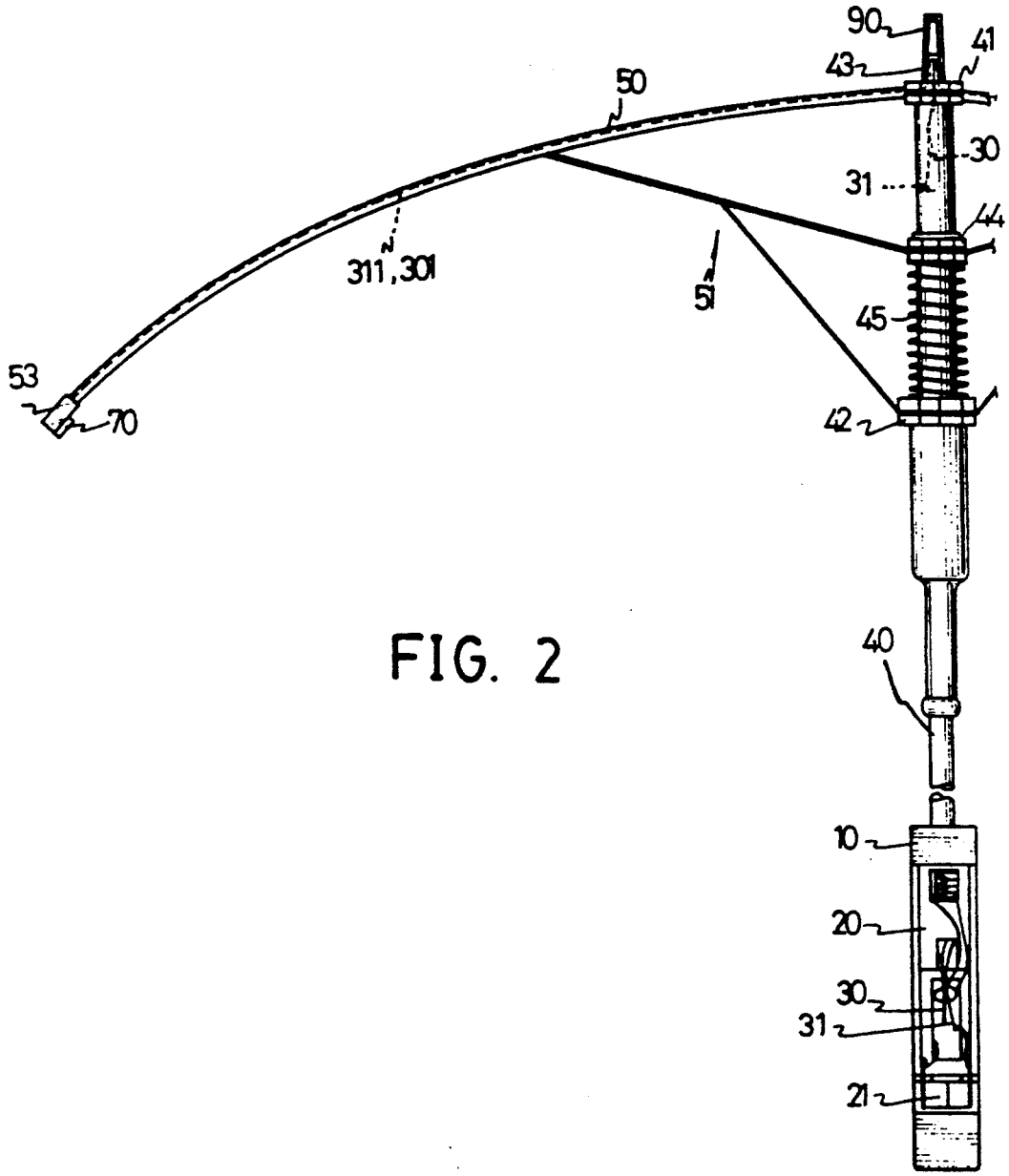
FIG. 2 is a partially sectional view of the umbrella of FIG. 1.
Figure 3:
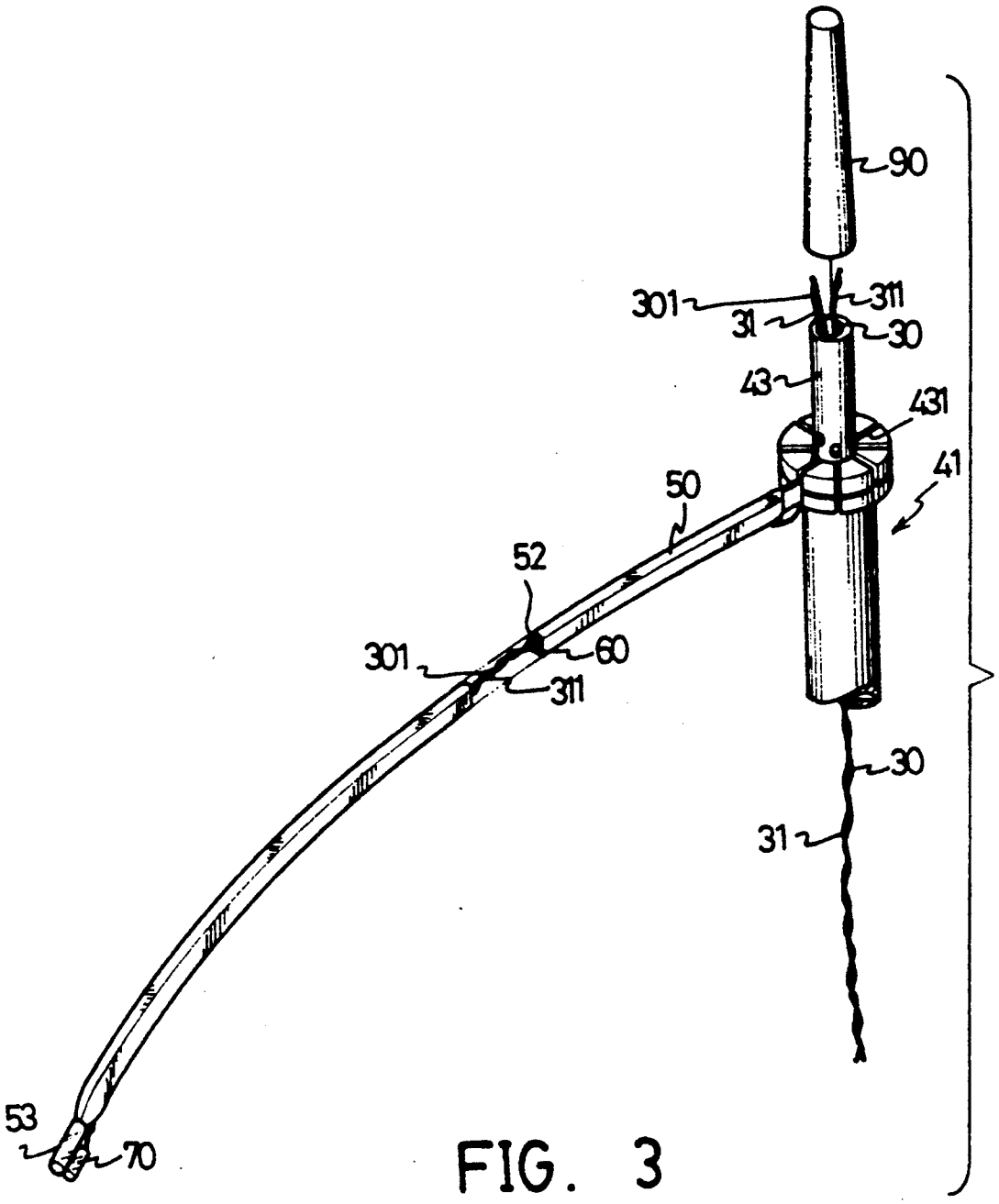
FIG. 3 is a partially exploded view of FIG. 2.

Referring to FIGS. 2 and 3, the rod 40 has a lower end connected to the handle 10 and an upper end connected to a sleeve means 41 which is further connected to the upper tube 43. The sleeve means 41 including an upper collar connected to a middle tube which is further connected to a lower collar. The lower collar of the sleeve means 41 is firmly fixed on the rod 40. An upper runner 44 and a lower runner 42 are telescopically fixed around the rod 40 under the sleeve means 41. The upper runner 44 is basically a tube structure having a collar at the top end thereof. The lower runner 42 is basically a tube structure having a collar at the top thereof and allowing to telescopically receive the upper runner 44 therein. A spring 45 has an upper end facing against the collar of the upper runner 44 and a lower end thereof fixed inside the lower runner 42.

A plurality of stretchers 51 each formed like a fork structure is pivotally engaged between a middle portion of a corresponding rib 50, the collar of the upper runner 44, and the collar of the lower runner 42. The theory of the stretch and finish utilizing the upper runner 44 and the lower runner 42 of the umbrella is well known and not described in detail herein. A plurality of ribs 50 are pivotally connected to the upper collar of the sleeve means 41 and extend in radial directions therefrom. Each rib 50 has three faces integrally formed one by one thus defining a channel therein. The upper tube 43 has a plurality of apertures 431 each corresponding to a rib 50 as mentioned. The positive electrical line 30 and the negative electrical line 3 extend from the circuit board 20 and elongate upward to an upper end of the upper tube 43. A plurality of branches 301 of the positive electrical line 30 extend from the upper end therefrom and each penetrates a corresponding aperture 431 and forward elongates along the channel of a corresponding rib 50. A plurality of branches 311 of the negative electrical line 31 extend from the upper end therefrom and each penetrates a corresponding aperture 431 and forward elongates along the channel of a corresponding rib 50. Therefore, each rib 50 has a pair of positive branch 301 and a negative branch 311 elongating along the channel therein. The plurality of tips 53 are each engaged to a corresponding rib 50 at the end thereof. The plurality of LEDs 70 attached on the tips 53 are each electrically connected to a corresponding pair of positive branch 301 and negative branch 311. A glue 60 is fed in the channel of the ribs 50 and applied on the connection points between the LED and the branches 301 and 311, thus further fixing the branches 301, 311 inside the ribs 50 and preventing short circuit at the connection points of the LEDs 70. A ferrule cap 90 is engaged at the top of the upper tube 43 for securely sealing the upper tube 43 preventing water entering thereinto. When the user wants to flash his umbrella he merely depresses the switch button 17, and the LEDs 70 will flash. When the user wants to turn off the LEDs 70, he merely depresses the switch button 17 again and the LEDs 70 will be turned off.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A flashing umbrella comprising a tubular handle, a hollow rod connected thereto, an upper tube connected to said rod at a top end thereof, said rod being in communication with said upper tube and said handle, an upper collar being formed substantially at a top periphery of said rod, a plurality of ribs being pivotally connected to said upper collar and extending in radial directions therefrom, each said rib being integrally formed with three faces thus defining a channel therein, a plurality of tips each engaged to one end of a corresponding said rib, a plurality of LEDs each being attached on a corresponding said tip, said handle having a recess on one face thereof for receiving a battery and a circuit board therein, a first cover being fit on an upper portion of said recess suitable to cover said circuit board, a second cover being fit on a lower portion of said recess suitable to cover said battery, said circuit board electrically connected to said battery and having a positive electrical line and a negative electrical line extending therefrom for providing electrical pulses thereacross, a button switch being installed on said first cover for turning ON/OFF said circuit board, a plurality of branches of said positive electrical line each being electrically connected to a corresponding LED, a plurality of branches of said negative electrical line each being electrically connected to a corresponding LED, each said rib receiving a pair of branches comprising one of said positive branches and one of said negative branches in the channel thereof, each said pair of branches providing pulses to a corresponding said LED when said circuit board is turned ON, a glue being fed in the channel of each said rib and applied on connection points between said LED and said pair of branches, thus further fixing said pair of branches inside said ribs and preventing short circuit between said connection points.

2. The flashing umbrella as claimed in claim 1 further comprises a ferrule cap engaged at a top of said upper tube for securely sealing said upper tube preventing water entering thereinto.

* * * * *